United States Patent [19]

Harpold

[11] Patent Number: 4,826,539

[45] Date of Patent: May 2, 1989

[54] CLEANING APPARATUS AND METHOD

[75] Inventor: Charles W. Harpold, Grand Rapids, Mich.

[73] Assignee: Harco Graphic Products, Inc., Grand Rapids, Mich.

[21] Appl. No.: 63,465

[22] Filed: Jun. 18, 1987

Related U.S. Application Data

[63] Continuation-in-part of Ser. No. 926,959, Nov. 4, 1986, abandoned.

[51] Int. Cl.[4] ..... B08B 7/04

[52] U.S. Cl. ..... 134/10; 134/25.1; 134/25.4; 134/21; 134/26; 134/171; 134/179; 15/320; 15/321; 15/302; 101/423; 101/424; 101/425; 228/206

[58] Field of Search ..... 134/10, 22.11, 169 A, 134/22.14, 168 R, 36, 37, 166 R, 167 R, 26, 21, 102, 179, 171, 180, 200; 210/923, 500–515; 15/320, 321, 302; 101/423, 424, 425; 228/206

[56] References Cited

U.S. PATENT DOCUMENTS

| | | | |
|---|---|---|---|
| 3,688,780 | 9/1977 | Everroad | 134/21 |
| 4,158,575 | 6/1979 | Townsend | 134/10 |
| 4,561,903 | 12/1985 | Blaul | 134/10 |
| 4,717,426 | 1/1988 | Brynildsen | 134/26 |

*Primary Examiner*—H. M. S. Sneed
*Assistant Examiner*—Sharon T. Cohen
*Attorney, Agent, or Firm*—Price, Heneveld, Cooper, DeWitt & Litton

[57] ABSTRACT

The specification discloses an apparatus and method for cleaning printing screens or the like work surfaces in which solvent is pumped from a reservoir to the surface to be cleaned at a point closely adjacent a vacuum cleaning tool. The vacuum cleaning tool is connected by a vacuum line to the reservoir and vacuum means are provided to draw a vacuum on the reservoir whereby solvent is delivered to the surface to be cleaned and residue laden solvent is vacuumed off the surface to be cleaned through the vacuum tool and vacuum line. A clean up tray and light panel are provided to facilitate the clean up operation. A control assembly comprising independently or simultaneously actionable foot pedals for control solvent feed and vacuum is provided.

33 Claims, 5 Drawing Sheets

CLEANING APPARATUS AND METHOD

This application is a continuation-in-part of pending U.S. application Ser. No. 06/926,959 filed Nov. 4, 1986 and now abandoned.

BACKGROUND OF THE INVENTION

The present invention relates to the problem of cleaning up water insoluble residue, such as inks used in printing. The present invention is especially well adapted to use in cleaning screens used in screen printing.

In screen printing, a screen having a pattern mask thereon is flooded with ink which is forced through the open pores of the screen onto the surface to be printed by means of a squeegee. After a run of printing has been completed, the screen has to be removed and cleaned.

Typically, dirty screens are cleaned by placing them in a sink, rinsing them with a solvent which will dissolve the ink, removing the screen and then flushing the solvent and ink down the drain with a stream of water. This is a very messy procedure. Perhaps more importantly, it is environmentally unsound. Even if a biodegradable solvent is used, the water insoluble ink itself is an unacceptable pollutant.

Also, they are sometimes cleaned by placing them on absorbant towelling, hand washing and rinsing them with flammable solvent which will remove the ink, and then drying them with absorbant towelling. The solvent soaked towelling is then discarded as waste, creating a continuing fire hazard.

SUMMARY OF THE INVENTION

The present invention comprises a method and apparatus for cleaning a water insoluble residue in which solvent is pumped from a solvent reservoir and directed onto the surface to be cleaned immediately adjacent a vacuum tool, which draws the solvent and any residue it has dissolved off of the surface to which the solvent has been applied and returns it to the sme solvent reservoir tank from which the solvent originated.

In a preferred aspect of the invention, the solvent used is water soluble and biodegradable. When it has become contaminated with residue, it is emptied into a container, to which water is added to dissolve the solvent and cause the non-water soluble residue to come out of solution. After suitable separation of the residue, the water and solvent mixture can then be flushed down a conventional drain while the residue can be disposed of in an environmentally acceptable manner.

These and other objects, advantages and features of the present invention will be more fully understood and appreciated by reference to the written specification and appended drawings.

DESCRIPTION OF THE PREFERRED EMBODIMENT

(a) First Embodiment

Figure 1:
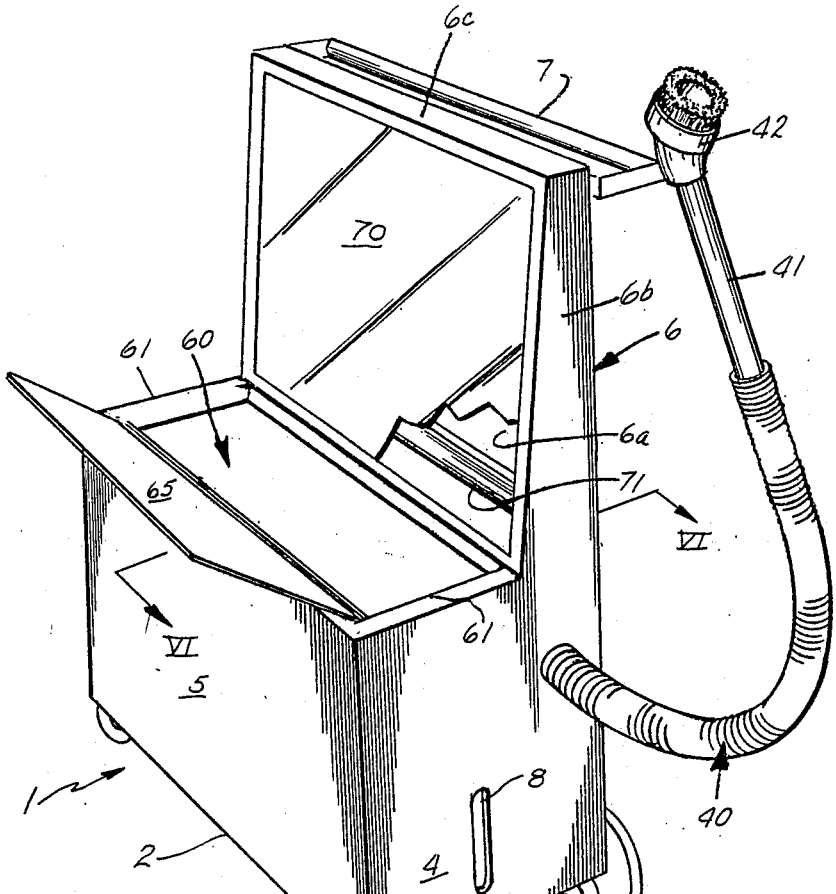
FIG. 1 is a perspective view of a first embodiment of the cleaning apparatus of the present invention.
Figure 2:
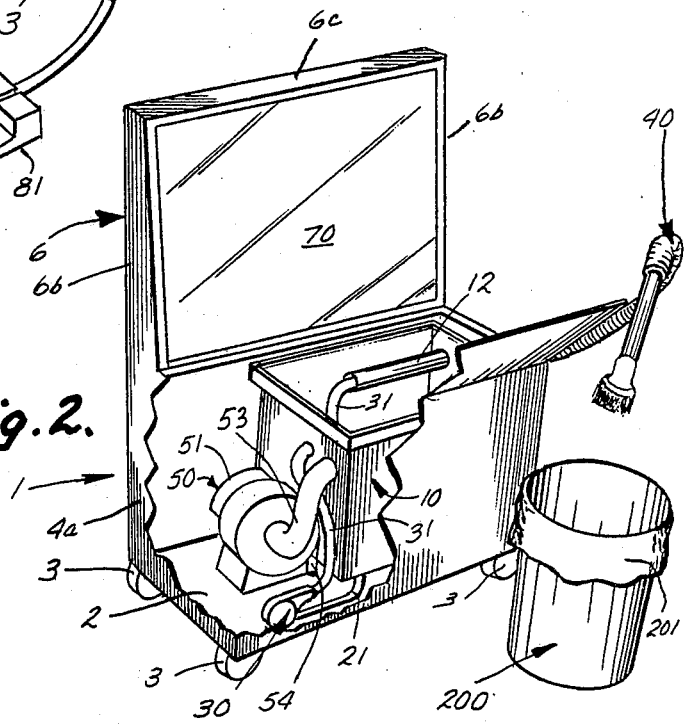
FIG. 2 is a partially broken, perspective view of the apparatus in FIG. 1 showing the end opposite that shown in FIG. 1.
Figure 4:
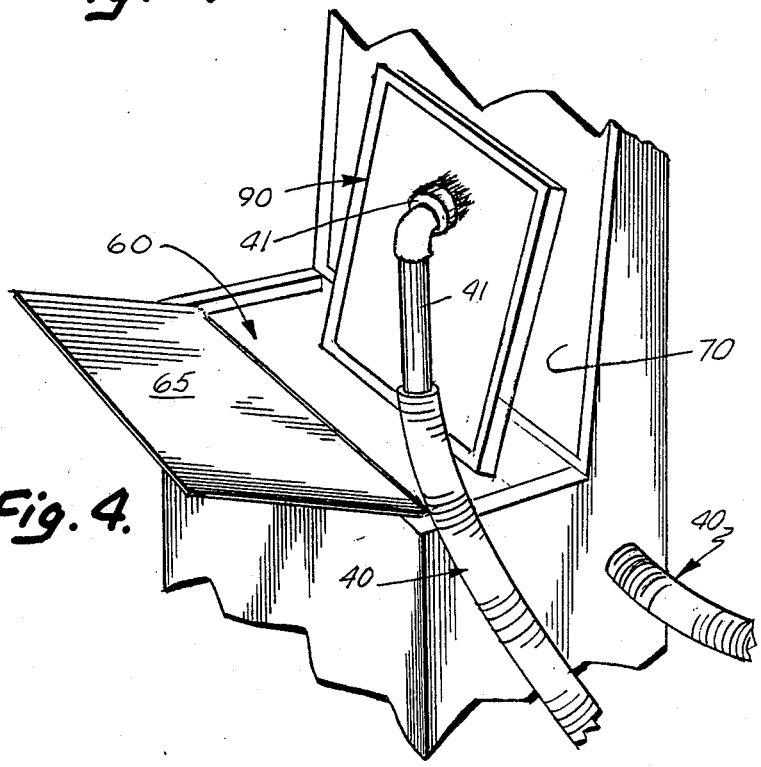
FIG. 4 is a perspective view illustrating a screen being cleaned.
Figure 5:
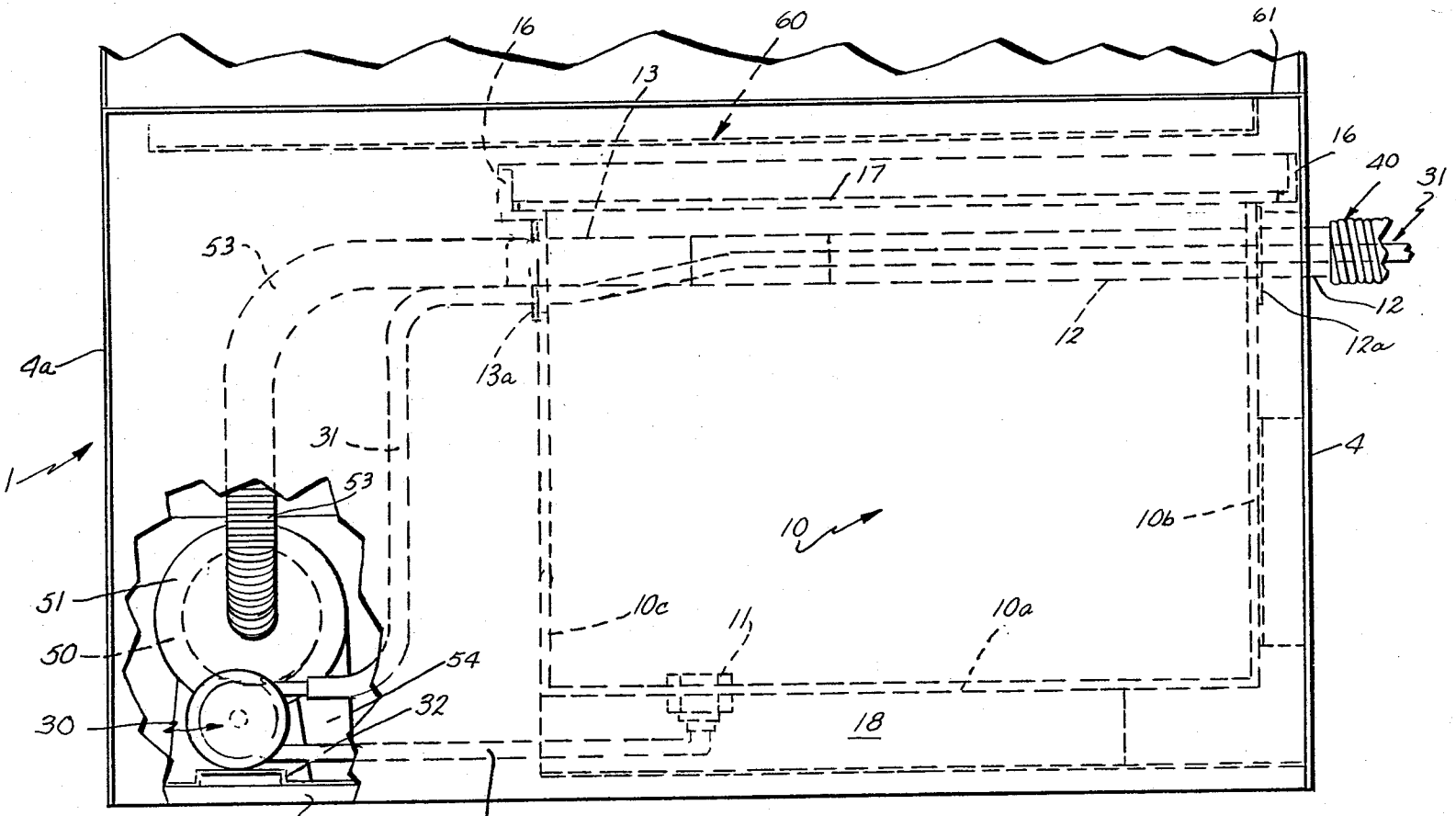
FIG. 5 is a partially broken, partially cross-sectional elevational view of the apparatus in FIG. 1.

In a first preferred embodiment (FIGS. 1–6), the cleaning apparatus of the present invention comprises a housing 1 containing a solvent reservoir 10 to which is operably connected a solvent pump 30, a solvent feed line 31, a vacuum hose 40 and a vacuum motor 50 (FIGS. 1, 2 and 5). A screen 90 or other object to be cleaned is placed in clean up tray 60 on top of housing 1 against a light panel 70 which illuminates the screen so that the operator can be sure it is cleaned (FIG. 4). Solvent is pumped from reservoir 10 by pump 30, through feed line 31 and onto the surface of the screen to be cleaned at a point generally adjacent the opening of a vacuum tool 42 on the end of vacuum hose 40. Vacuum motor 50 draws a vacuum on reservoir 10 so as to draw residue laden solvent back through vacuum hose 40 and back into reservoir 10. This process is continued until inspection of the screen in the light emanating from light panel 70 indicates that it is satisfactorily clean. Control of the pumping and vacuum functions is controlled by foot pedal control assembly 80.

Housing 1 is made of a rigid, structural material such as sheet metal or structural solvent resistant plastic. It comprises a base 2 mounted on four casters 3 to give mobility to the entire apparatus (FIGS. 1, 2 and 5). Projecting upwardly from each end of base 3 are end walls 4 and **4*a*. These are joined on one side by a sidewall 5 of comparable height. End wall 4, 4*a* includes a vertical slot opening 8, which serves as a viewing port for determining solvent level in reservoir 10**, as explained below.

Sidewall 6 opposite sidewall 5 is approximately twice as high as sidewall 5 and end walls 4 and **4*a*. It comprises a panel 6*a* secured to an upwardly extending frame consisting of triangular sides 6*b* and a top wall 6*c*. Panel 6*a* is removable to facilitate servicing. A combined handle and hanging rail 7 is mounted at the top of high sidewall 6, at the corners where frame sides 6*b* join frame top wall 6*c*, and extends generally from one side thereof to the other. Handle 7 is at such a height that it can be readily grasped by the user to move the apparatus from one place to another. Handle 7 also provides a convenient rail upon which items can be hung, including the vacuum wand 41 and cleaning tool 42 at the end of vacuum hose 40. Hanging wand 41 up on handle 7 when it is not in use insures that solvent in hose 40 or feed line 31 inside hose 40** will not run out onto the floor.

High sidewall 6 serves not only to facilitate this elevated positioning of handle 7, but also serves as a support for light panel 70 which slopes downwardly and away from the top of high sidewall 6. The top of housing 1 in front of light panel 70 is covered by the removable clean up tray 60.

Figure 3:
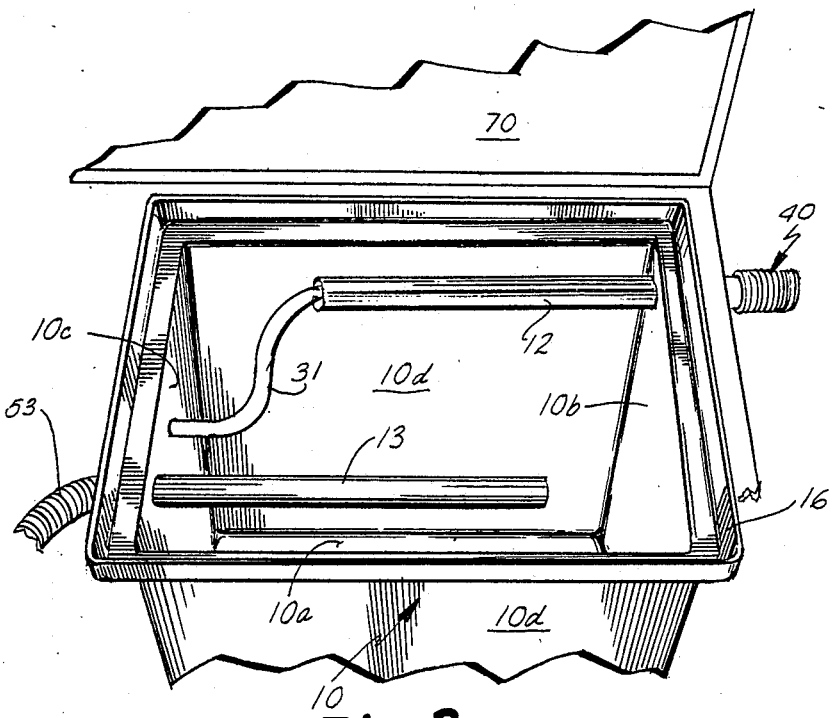
FIG. 3 is a slightly elevated, partially broken perspective view of the apparatus in FIG. 1 with the clean up tray and solvent reservoir cover removed.

Solvent reservoir 10 is mounted within the confines of housing 1 (FIGS. 2, 3 and 5). Reservoir 10 comprises a bottom wall 10*a*, an inlet end wall 10*b*, an outlet end wall 10*c* and spaced sidewalls 10*d*. Sidewalls 10*d* and end walls 10*b* and 10*c* terminate at an outwardly and then upwardly projecting upper rim 16 which snugly receives a top cover 17 which serves to seal the interior of reservoir 10.

Reservoir 10 and cover 17 are made of a structural polymeric material which is at least translucent. The plastic used must be inert to solvent attack, e.g., polyethylene. This allows light from light 71 (FIG. 1) to shine through cover 17 and through inlet end wall 10*b* so that the level of solvent in reservoir 10 can be determined by looking through the viewing port 8 in end wall 4 of housing 1.

A solvent outlet fitting 11 is positioned in bottom wall 10*a* (FIG. 5). A metal vacuum and solvent inlet pipe 12, including a mounting flange 12*a*, for receiving vacuum hose 40 is mounted in inlet end wall 10*b*. A metal vacuum outlet pipe 13, including mounting flange 13*a*, is located in outlet wall 10*c*. Solvent is drawn out of reservoir 10 through bottom fitting 11. The dirtied solvent is drawn back into reservoir 10 through inlet pipe 12. A vacuum is drawn on reservoir 10 by evacuating air through vacuum pipe 13.

Inlet pipe 12 and vacuum pipe 13 extends sufficiently far into reservoir 10, in opposite direction, as to act as a baffle system preventing solvent from being drawn into the open end of vacuum outlet pipe 13 (FIG. 3). Inlet pipe 12 extends from inlet wall 10*b* substantially across the length of reservoir 10 to within a few inches of outlet wall 10*c*. Outlet pipe 13 extends from its point of entry in outlet wall 10*c* generally across the length of reservoir 10 to within a few inches of inlet wall 10*b*. With inlet pipe 12 and outlet vacuum pipe 13 so oriented, it is highly unlikely that incoming solvent entering reservoir 10 through the end of inlet pipe 12 could be drawn into the open end of vacuum outlet pipe 13.

Reservoir 10 is mounted on bottom brackets 18 which space the bottom wall 10*a* of tank 10 above the level of base 2 a short distance, e.g. about two inches (FIG. 5). This space leaves room for solvent outlet line 20 to pass beneath the bottom wall 10*a* of tank 10.

Solvent outlet line 20 is connected to solvent outlet fitting 11 and extends outwardly from beneath tank 10 to pump 30. It is made of a solvent resistant material such as polyethylene tubing. A check valve is optionally located along solvent outlet line 20. In the most preferred embodiment, a check valve has been found not essential.

Pump 30 is a high pressure pump using a 1/11 horsepower electrical motor. The "Little Giant" pump from Tecumseh Products Company operates well in this application. Pump 30 is mounted on base 2 via bracket 32. Pump 30 must have sufficient draw to overcome the vacuum within tank 10 and draw fluid out of tank 10.

Solvent feed line 31, comprising a solvent resistant material such as polyethylene tubing, extends upwardly from solvent pump 30 through an opening in outlet end wall 10*c* which is located near the top thereof generally adjacent vacuum outlet pipe 13 (FIGS. 3 and 5). Solvent feed line 31 then extends through reservoir 10 below cover 17 and out of reservoir 10 through inlet pipe 12 and vacuum line 40. It extends the length of vacuum line 40 and terminates at a point adjacent the opening of a brush tool 42 mounted on the end of vacuum wand 41.

Solvent feed line 31 is intentionally oriented such that it passes through outlet end wall 10*c* at a point remote from the open end of inlet pipe 12. This requires that solvent feed line include at least two bends between the end of inlet pipe 12 and the opening in end wall 10*c* through which it passes, helping to minimize the possibility that solvent entering through inlet pipe 12 might flow down the length of the outside of solvent feed line 31 and migrate to the exterior of reservoir 10 where solvent feed line 31 enters reservoir 10. It is of course important that a snug seal be maintained at that juncture so that the vacuum drawn on reservoir 10 by vacuum motor 50 is not diminished.

Vacuum line 40 is a conventional corrugated plastic vacuum hose which communicates with reservoir 10 via connection to the end of inlet pipe 12. It must be made of a solvent resistant material such as polyethylene. Wand 41 is a piece of metal tubing as is conventionally secured to the end of a flexible vacuum hose. Brush 42 is a conventional vacuum cleaning tool made of solvent resistant material comprising a body portion which fits over wand 41 and a brush head comprised of a plurality of brush bristles.

Vacuum motor 50 is of the type used in vacuum cleaners. Motor 50 drives an impeller (not shown) located in impeller housing 51 (FIGS. 2 and 5). Motor 50 and impeller housing 51 are mounted on base 2. A vacuum hose 53 is fixed to the exterior end of vacuum outlet pipe 13 at one end and to the impeller intake opening in impeller housing 51 at the other end. Air drawn through outlet pipe 13 is exhausted from impeller housing 51 through a tangential outlet 54 through an outlet opening in base 2. By exhausting through base 2, noise is minimized.

Clean up tray 60 comprises a shallow metal or plastic tray having a peripheral lip flange 61 which facilitates positioning clean up tray 60 in the opening at the top of housing 1 (FIGS. 1 and 5). Clean up tray 60 thus is positioned directly in front of light panel 70. It is approximately one inch deep so that it can catch any solvent which may drip from or is allowed to flow from the end of brush tool 42. Tray 60 is preferably made of metal, though it can be made of a plastic material which will resist attack by organic solvents, e.g. polyethylene. Metal also provides a smooth surface from which any solvent can readily be wiped up.

Figure 6:
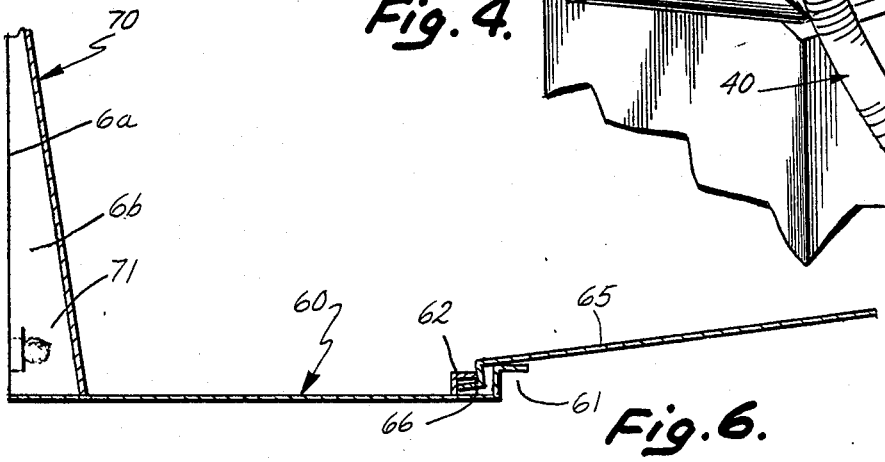
FIG. 6 is a cross-sectional view taken along plane VI–VI of FIG. 1, showing the construction of the clean up tray and drip pan of the apparatus.

A drip pan or splash pan 65 is removably mounted on clean up tray 60 (FIGS. 1, 4 and 6). Clean up tray 60 includes an upwardly and then laterally outwardly projecting catch lip 62 positioned towards its edge remote from light panel 70. Drip pan 65 comprises a large, generally flat metal panel, with a generally "L" shaped deviation along one edge defining a catch mounting flange 66. In order to mount drip pan 65 in position, one simply hooks catch mounting flange 66 beneath catch lip 62, leaving the bottom of pan 65 resting on cover lip flange 61. Drip pan 65 allows one to manipulate a screen being cleaned, as for example by turning it around, without having solvent drip off the screen onto the floor. Drip pan 65 also helps catch any splash of solvent occurring when one is operating the apparatus.

Light panel 70 is a sheet of solvent resistant plastic material such as polyethylene. It is translucent so that light will pass through it. It is supported by suitable brackets such that its top is closely adjacent vertical sidewall 6 of housing 1 and its bottom is spaced from vertical wall 6 a distance of about six inches. A light 71 is mounted on the inside of vertical wall 6 behind light panel 70 (FIG. 1). Light 71 is a conventional fluorescent tube about two feet long. Light 71 is mounted near the middle of vertical sidewall 6 so that it will shine not only upwardly against light panel 70, but also downwardly into reservoir 10, thus facilitating solvent viewing through viewport 8 in housing end wall 4.

Pump 30 and vacuum motor 50 are controlled by a foot pedal control assembly 80 (FIG. 1). Assembly 80 comprises a base 81 and a pair of independently operable pedals, one being pump actuating pedal 82 and the other being vacuum actuating pedal 83. Electrical wiring 84 connects control assembly 80 to housing 1 and operably to vacuum motor 50 on pump 30. When the master switch of the apparatus is activated, light 71 is turned on. Depression of pump pedal 82 operates pump 30 and pumps solvent through solvent feed line 31. Depression of vacuum pedal 83 activates vacuum motor 50 and draws a vacuum through vacuum hose 40. Pump pedal 82 and vacuum pedal 83 are located adjacent one another so that they can be activated simultaneously.

Reservoir 10 is filled with solvent by placing wand 41 (with brush 42 attached if desired) into a five gallon container filled with solvent. The apparatus master switch is activated and the vacuum foot pedal 83 is depressed. This draws solvent out of the five gallon container, through vacuum hose 40 and inlet pipe 12 and into reservoir 10. Reservoir 10 is of such a size that it conveniently holds five gallons of solvent.

The solvent used is preferably biodegradable, water soluble and nonflammable. It must of course dissolve the particular ink or non-water soluble residue which one seeks to clean up. By using the preferable biodegradable solvent, one can dispose of the solvent through a conventional drainage system, or a light industrial drainage system. By making the solvent water soluble, one enhances final clean up in that ink or like residue dissolved in the solvent can readily be separated out by introducing water into the ink saturated solvent. By using a nonflammable solvent, one minimizes the danger of explosions or fires. Such biodegradable, water soluble, nonflammable solvents are commercially available. Harco IV 1000 is commercially available from Harco Graphic Products, Inc.

To clean a printing screen 90 or the like, one locates the screen in clean up tray 60, leaning it against light panel 70 (FIG. 4). One first depresses pump pedal 82, holding vacuum tool 42 over tray 60, and holds pump pedal 82 down until solvent begins flow out of brush attachment 42. One then simultaneously depresses pump pedal 82 and vacuum pedal 83 while scrubbing the screen with brush attachment 42. It is helpful to occasionally release pump pedal 82 while continuing to depress vacuum pedal 83 to remove excess solvent from the screen and clean up tray 60. The screen can readily be turned around without dripping solvent onto the floor adjacent the apparatus thanks to drip pan 65.

Once the screen is clean, it can be set aside and the apparatus cleaned up. Using brush 42, one washes and vacuums any ink or like residue from light panel 70 and one then vacuums all liquid from clean up tray 60 by depressing only vacuum pedal 83.

When the biodegradable, water soluble, nonflammable solvent is so saturated with ink that further cleaning is not possible, one places wand 41, with brush 42 attached if desired, into a container and depresses pump pedal 82 to pump all of the solvent out of reservoir 10 into the container. Preferably, the container 200 is lined with a plastic bag 201 (FIG. 3).

Once pump out is completed, the ink saturated solvent in container 200 is diluted approximately 50–50 with water and allowed to stand a few moments. The ink or other non-water soluble residue will separate from the resulting solution. If a plastic bag 201 has been used, much of the ink will adhere thereto. The water and solvent solution can be decanted off, or more preferably can be poured through a filter into a sink, allowing the filter to filter out any of the separated ink or other insoluble residue. The filter is then disposed of in an environmentally acceptable manner.

(b) Second Embodiment

Figure 7:
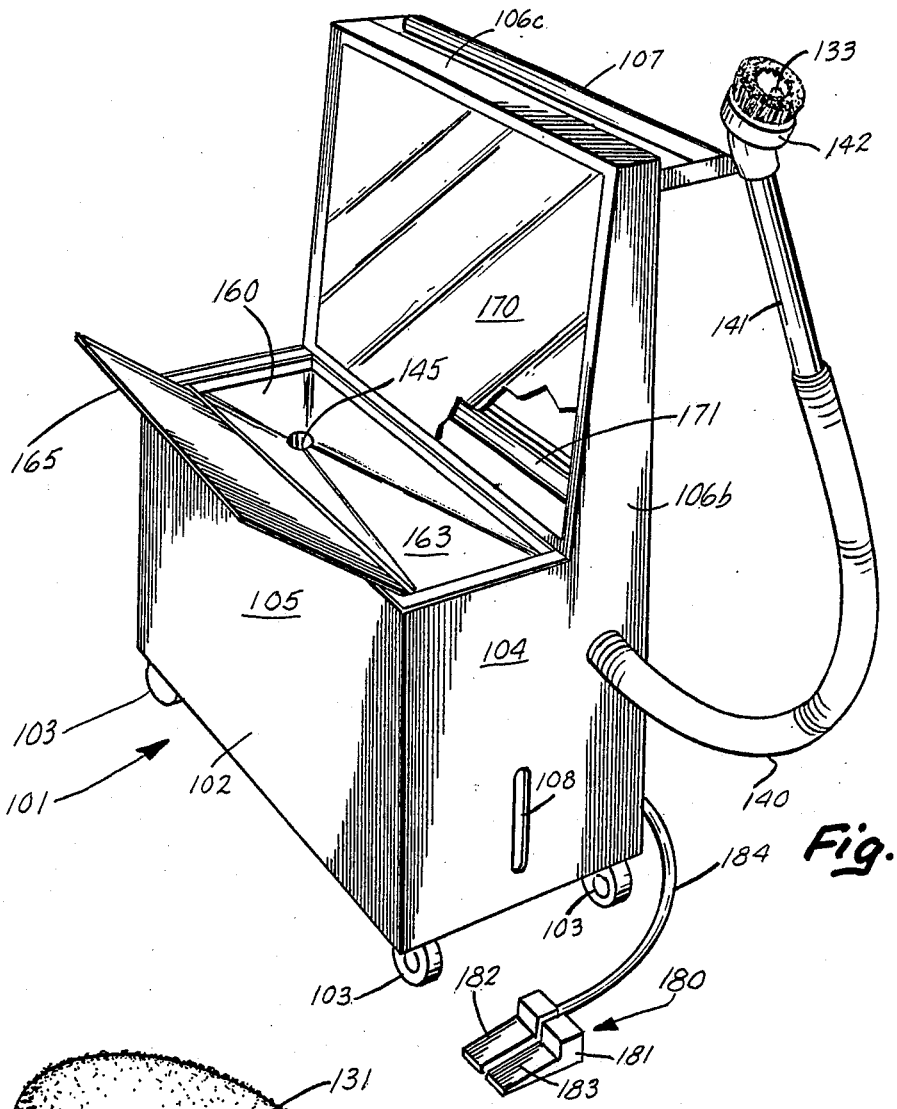
FIG. 7 is a perspective view of a second embodiment of the cleaning apparatus of the present invention.
Figure 8:
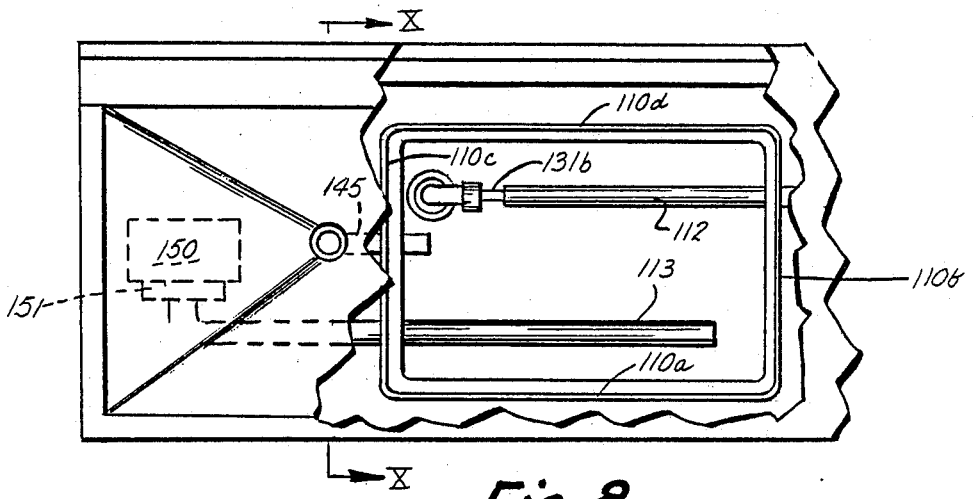
FIG. 8 is a partially broken, top plan view of the apparatus shown in FIG. 7 with the solvent tank cover removed.
Figure 9:
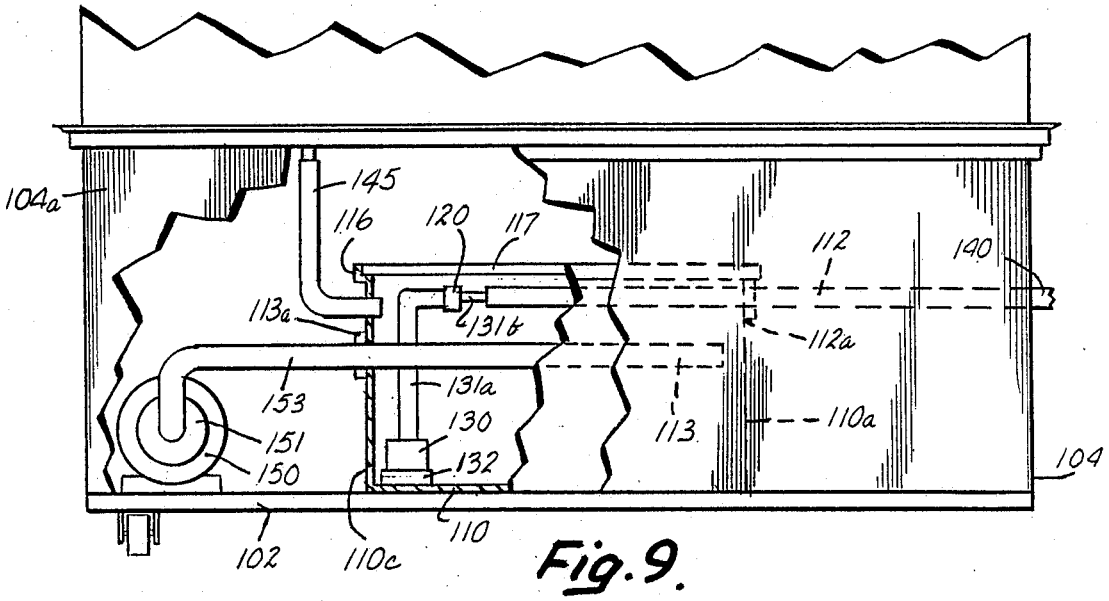
FIG. 9 is a partially broken side elevational view of the apparatus shown in FIG. 7.

In a second, most preferred embodiment (FIGS. 7–11), the cleaning apparatus of the present invention comprises a housing 101 containing a solvent reservoir 110 in which is operably located a submersible solvent pump 130 and to which is operatively connected a vacuum hose 140 and a Vacuum motor 150 (FIGS. 7, 8 and 9). Solvent is pumped from reservoir 110 by pump 130, through feed line 131 and onto the surface of the screen to be cleaned at a point generally adjacent or within the opening of a vacuum tool 142 on the end of vacuum hose 140. Vacuum motor 150 draws a vacuum on reservoir 110 so as to draw residue laden solvent from the screen back through vacuum hose 140 and back into reservoir 110. This process is continued until inspection of the screen in the light emanating from light panel 170 indicates that it is satisfactorily clean. Excess residue laden solvent is returned to reservoir 110 through return pipe 145. Control of the pumping and vacuum functions is controlled by foot pedal control assembly 180.

Housing 101 is made of a rigid, structural material such as sheet metal or structural solvent resistant plastic. It comprises a base 102 mounted on four casters 103 to give mobility to the entire apparatus (FIGS. 7 and 9). Projecting upwardly from each end of base 102 are end walls 104 and **104*a*. These are joined on one side by a sidewall 105 of comparable height. End wall 104 includes a vertical slot opening 108, which serves as a viewing port for determining solvent level in reservoir 110**, as explained below.

Sidewall 106 opposite sidewall 105 is approximately twice as high as sidewall 105 and end walls 104 and **104*a*. It comprises a panel 106*a* secured to an upwardly extending frame consisting of triangular sides 106*b* and a top wall 106*c*. Panel 106*a* is removable to facilitate servicing. A combined handle and hanging rail 107 is mounted at the top of high sidewall 106, at the corners where frame sides 106*b* join frame top wall 106*c*, and extends generally from one side thereof to the other. Handle 107 is at such a height that it can be readily grasped by the user to move the apparatus from one place to another. Handle 107 also provides a convenient rail upon which items can be hung, including the vacuum wand 141 and cleaning tool 142 at the end of vacuum hose 140. Hanging wand 141 up on handle 107 when it is not in use insures that solvent in hose 140 or feed line 131 inside hose 140** will not run out onto the floor.

High sidewall 106 serves not only to facilitate this elevated positioning of handle 107, but also serves as a support for ligh panel 170 which slopes downwardly and away from the top of high sidewall 106. The top of housing 101 in front of light panel 170 is covered by the clean up tray 160.

Solvent reservoir 110 is mounted within the confines of housing 101 (FIGS. 8 and 9). Reservoir 110 comprises a bottom wall 110*a*, an inlet end wall 110*b*, an outlet end wall 110*c* and spaced sidewalls 110*d*. Sidewalls 110*d* and end walls 110*b* and 110*c* terminate at an outwardly and then upwardly projecting upper rim 116 which snugly receives a top cover 117 which serves to seal the interior of reservoir 110

Reservoir 110 and cover 117 are made of a structural polymeric material which is at least translucent. The plastic used must be inert to solvent attack, e.g., polyethylene. This allows light from light 171 (FIG. 7) to shine through cover 117 and through inlet end wall 110*b* so that the level of solvent in reservoir 110 can be determined by looking through the viewing port 108 in end wall 104 of housing 101.

A metal vacuum and solvent inlet pipe 112, including a mounting flange 112*a*, for receiving vacuum hose 140 is mounted in inlet end wall 110*b*. A metal vacuum outlet pipe 113, including mounting flange 113*a*, is located in outlet wall 110*c*. The dirtied solvent is drawn by vacuum back into reservoir 110 through inlet pipe 112 or through return pipe 145. A vacuum is drawn on reservoir 110 by evacuating air through vacuum pipe 113.

Inlet pipe 112 and vacuum pipe 113 extends sufficiently far into reservoir 110, in opposite direction, as to act as a baffle system preventing solvent from being drawn into the open end of vacuum outlet pipe 113 (FIGS. 8 and 9). Inlet pipe 112 extends from inlet wall 110*b* substantially across the length of reservoir 110 to within several inches of outlet wall 110*c*. Outlet pipe 113 extends from its point of entry in outlet wall 110*c* generally across the length of reservoir 110 to within several inches of inlet wall 110*b*. With inlet pipe 112 and outlet vacuum pipe 13 so oriented, it is highly unlikely that incoming solvent entering reservoir 110 through the end of inlet pipe 112 could be drawn into the open end of vacuum outlet pipe 113.

Return pipe 145 extends into reservoir 110 only a few inches from wall 110*c*. With return pipe 145 so oriented with respect to outlet vacuum pipe 113, it is highly unlikely that incoming solvent entering reservoir 110 through the open end of return pipe 145 could be drawn into the open end of vacuum outlet pipe 113. As positioned, return pipe 145 and vacuum outlet pipe 113 act as a baffle system.

Pump 130 is a submersible high pressure pump. The Model 2P406 epoxy encapsulated pump from Teel Manufacturing Company operates well in this application. Pump 130 is mounted via its fluid inlet assembly 132 on the bottom of reservoir 110. Pump 130 and its motor (not shown) must be enclosed in a liquid sealed housing having sufficient draw to overcome the vacuum within tank 110 and draw fluid out of tank 110. Pump 130 draws solvent through its inlet assembly 132 and discharges solvent under pressure to a discharge line 131*a*.

Figure 11:
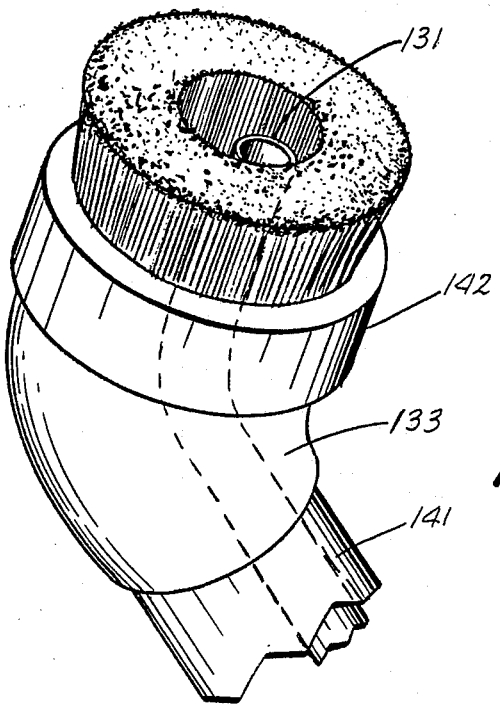
FIG. 11 is a perspective view of the vacuum wand used with the second embodiment.

Discharge line 131*a*, comprising a solvent resistant material, such as polyethylene tubing, extends upwardly from solvent pump 130 to check valve 120. A solvent feed line 131*b* (FIG. 9) extends from check valve 120 inside vacuum inlet pipe 112 to a rigid metal tube 131*c* welded to the interior of vacuum wand 141 (FIG. 11). Solvent feed line 131*b* comprises a flexible, solvent resistant material such as neoprene rubber. A flexible discharge tube 133 extends from tube 131*c* and is disposed in the opening of brush tool 142 (FIGS. 7 and 11). Discharge tube 133 terminates in tool 142 slightly before the end of the brush bristles and is made of a flexible solvent resistant material to avoid damaging the screen should brush tool 142 be pressed forcibly against the screen.

Vacuum line 140 is a conventional corrugated plastic vacuum hose which communicates with reservoir 110 via connection to the end of inlet pipe 112. It must be made of a solvent resistant material such as polyethylene. Wand 141 is a piece of metal tubing as is conventionally secured to the end of a flexible vacuum hose. Brush 142 is a conventional vacuum cleaning tool made of solvent resistant material comprising a body portion which fits over wand 141 and a brush head comprised of a plurality of brush bristles.

Figure 10:
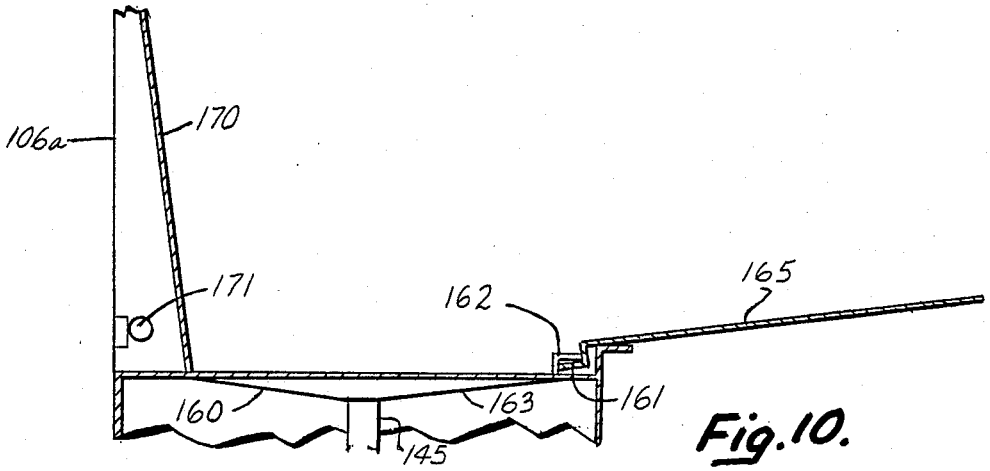
FIG. 10 is a partial elevational view taken along the lines X–X in FIG. 8.

Vacuum motor 150 is of the type used in vacuum cleaners. Motor 150 drives an impeller (not shown) located in impeller housing 151 (FIGS. 8 and 10). Motor 150 and impeller housing 151 are mounted on base 102. A vacuum hose 153 is fixed to the exterior end of vacuum outlet pipe 113 at one end and to the impeller intake opening in impeller housing 151 at the other end. Air drawn through outlet pipe 113 is exhausted from impeller housing 151 through a tangential outlet (not shown) through an outlet opening in base 102. By exhausting through base 102, noise is minimized.

Clean up tray 160 comprises a shallow metal or plastic tray having a peripheral lip flange 161, which facilitates positioning clean up tray 160 in the opening at the top of housing 101 (FIGS. 7 and 10). Clean up tray 160 thus is positioned directly in front of light panel 170. It is approximately one inch deep so that it can catch any solvent which may drip from or is allowed to flow from the end of brush tool 142. Tray 160 comprises a large, generally flat metal panel, with a bottom 163 that slopes downwardly toward return pipe 145. Clean up tray 160 includes an upwardly and then laterally outwardly projecting catch lip 162 positioned towards its edge remote from light panel 170 (FIG. 10). Tray 160 is preferably made of metal, though it can be made of a plastic material which will resist attack by organic solvents, e.g. polyethylene. Metal also provides a smooth surface from which any solvent can readily be wiped up.

A drip pan or splash pan 165 is removably mounted on clean up tray 160 (FIGS. 7 and 10). Drip pan 165 has a generally "L" shaped deviation along one edge defining a catch mounting flange 166. In order to mount drip pan 165 in position, one simply hooks catch mounting flange 166 beneath catch lip 162, leaving the bottom of pan 165 resting on cover lip flange 161. Drip pan 165 allows one to manipulate a screen being cleaned, as for example by turning it around, without having solvent drip off the screen onto the floor. Drip pan 165 also helps catch and return to reservoir 110 any splash of solvent occurring when one is operating the apparatus.

Light panel 170 is a sheet of solvent resistant plastic material such as polyethylene. It is translucent so that light will pass through it. It is supported by suitable brackets such that its top is closely adjacent vertical sidewall 106 of housing 101 and its bottom is spaced from vertical wall 106 a distance of about six inches. A light 171 is mounted on the inside of vertical wall 106 behind light panel 170 (FIG. 7). Light 171 is a conventional fluorescent tube about two feet long. Light 171 is mounted near the middle of vertical sidewall 106 so that it will shine not only upwardly against light panel 170, but also downwardly into reservoir 110, thus facilitating solvent viewing through viewport 108 in housing end wall 104.

Pump 130 and vacuum motor 150 are controlled by a foot pedal control assembly 180 (FIG. 7). Assembly 180 comprises a base 181 and a pair of independently operable pedals, one being pump actuating pedal 182 and the other being vacuum actuating pedal 183. Electrical wiring 184 connects control assembly 180 to housing 101 and operably to vacuum motor 150 and pump 130. When the master switch (not shown) of the apparatus is activated, light 171 is turned on. Depression of pump pedal 182 operates pump 130 and pumps solvent through solvent feed line 131. Depression of vacuum pedal 183 activates vacuum motor 150 and draws a vacuum through vacuum hose 140. Pump pedal 182 and vacuum pedal 183 are located adjacent one another so that they can be activated simultaneously.

Reservoir 110 is filled with solvent by placing wand 141 (with brush 142 attached if desired) into a five gallon container filled with solvent. The apparatus master switch is activated and the vacuum foot pedal 183 is depressed. This draws solvent out of the five gallon container, through vacuum hose 140 and inlet pipe 112 and into reservoir 110. Reservoir 110 is of such a size that it conveniently holds five gallons of solvent.

To clean a printing screen 190 or the like, one locates the screen in clean up tray 160, leaning it against light panel 170. One first depresses pump pedal 182, holding vacuum tool 142 over tray 160, and holds pump pedal 182 down until solvent begins flow out of brush attachment 142. One then simultaneously depresses pump pedal 182 and vacuum pedal 183 while scrubbing the screen with brush attachment 142. It is helpful to occasionally release pump pedal 182 while continuing to depress vacuum pedal 183 to remove excess solvent from the screen. The screen can readily be turned around without dripping solvent onto the floor adjacent the apparatus thanks to drip pan 165.

Once the screen is clean, it can be set aside and the apparatus cleaned up. Using brush 142, one washes and vacuums any ink or like residue from light panel 170 and clean up tray 160.

When the biodegradable, water soluble, nonflammable solvent is so saturated with ink that further cleaning is not possible, one places wand 141, with brush 142 attached if desired, into a container and depresses pump pedal 182 to pump all of the solvent out of reservoir 110 into the container.

Of course, the above are preferred embodiments of the invention and various changes and alterations can be made without departing from the spirit and broader aspects thereof.

The embodiments of the invention in which an exclusive property or privilege is claimed are defined as follows:

1. A compact, self-contained cleaning apparatus for solvent cleaning printing ink from a printing screen comprising:

a solvent reservoir for holding organic solvent;

a clean up tray for catching solvent and ink from a printing screen;

vacuum means operably connected to said reservoir for drawing a vacuum on said reservoir, said vacuum means being operably connected to said reservoir near the top thereof and above the level to which the reservoir is to be filled with solvent;

a vacuum hose extending from said reservoir and including a cleaning tool mounted on an end thereof remote from said reservoir said cleaning tool having brush means for loosening ink from the screen and means for defining a vacuum opening in said cleaning tool connected to said vacuum hose such that a vacuum is drawn on said vacuum opening to remove loosened ink from said screen;

solvent pump means operably connected at an inlet of said pump to said reservoir for pumping solvent out of said reservoir at an outlet of said pump;

a solvent feed line extending from said outlet of said solvent pump to a terminal end located adjacent said brush means on said cleaning tool whereby solvent is pumped by said solvent pump means from said solvent reservoir, through said feed line and onto a work surface to be cleaned adjacent said brush means on said cleaning tool to wet the brush means with solvent, and whereby solvent containing cleaned up printing ink is drawn through said vacuum opening by vacuum back through said vacuum line and back into said solvent reservoir such that the solvent in said reservoir is continuously recycled to the work surface to cooperate with the scrubbing action of said brush means to loosen and remove ink from a screen.

2. The apparatus of claim 1 which additionally includes a generally vertical to slightly inclined light panel and light means positioned behind said light panel for illuminating said light panel; clean up tray positioned in front of said light panel whereby one can position the object to be cleaned in front of said light panel to thereby illuminate the object during cleaning.

3. The apparatus of claim 2 which includes a drip pan including mounting means facilitating releasably mounting said drip pan adjacent said clean up tray.

4. The apparatus of claim 3 in which said clean up tray includes an upwardly and laterally outwardly projecting catch lip near an edge thereof spaced from said light panel, said drip pan including a downwardly and then laterally projecting catch flange which fits under and engages said catch lip on said clean up tray to thereby facilitate said releasable mounting of said drip pan on said clean up tray.

5. The apparatus of claim 4 in which said clean up tray includes a generally flat bottom sloping downwardly toward a solvent return pipe connecting said tray to said reservoir.

6. The apparatus of claim 2 in which said solvent reservoir is located within a housing, said light panel and said clean up tray being positioned on top of said housing.

7. The apparatus of claim 6 in which said housing includes a generally vertical wall extending upwardly above the level of said reservoir, said light panel being supported by said upwardly extending generally vertical wall.

8. The apparatus of claim 6 in which said light means is mounted in said generally vertical wall extending upwardly above the level of said tank, in a position so as to shine not only upwardly onto said light panel but also downwardly into said housing;

said reservoir being located within said housing below said light means and being made of translucent material whereby light shines through said reservoir;

said housing including a viewing port opening in one wall which enables one to see light shining through said reservoir and judge the level of solvent.

9. The apparatus of claim 7 including a handle positioned at the top of said upwardly extending vertical wall to facilitate maneuvering said apparatus and to facilitate hanging accessories on said apparatus.

10. The apparatus of claim 9 including casters at the bottom thereof to facilitate movement thereof.

11. The apparatus of claim 2 which includes baffle means positioned within said solvent reservoir thereby minimizing the flow of solvent out of said reservoir through said vacuum means.

12. The apparatus of claim 11 in which said baffle means comprises a vacuum and solvent inlet pipe extending from one end wall of said reservoir a substantial distance towards the opposite end wall of said reservoir and a vacuum outlet pipe extending from said opposite end wall a substantial distance towards said first end wall whereby the possibility of solvent flowing directly from said inlet pipe into the opening of said vacuum outlet pipe is minimized.

13. The apparatus of claim 12 in which said solvent feed line extends through the interior of said vacuum line and terminates at the interior of said cleaning tool.

14. The apparatus of claim 13 in which said solvent line terminates in a flexible discharge portion.

15. The apparatus of claim 2 in which said solvent feed line extends through the interior of said vacuum line and terminates at the interior of said cleaning tool.

16. The apparatus of claim 15 in which said solvent line terminates in a flexible discharge portion.

17. The apparatus of claim 2 including control means comprising a pump pedal for activating said solvent pump when depressed and a vacuum pedal for activating said vacuum means when depressed, said pedals being closely adjacent whereby they can be depressed independently of one another or injunction with one another.

18. The apparatus of claim 17 in which said solvent reservoir is located within a housing, said light panel and said clean up tray being positioned on top of said housing.

19. The apparatus of claim 18 which includes baffle means positioned within said solvent reservoir thereby minimizing the flow of solvent out of said reservoir through said vacuum means.

20. The apparatus of claim 19 in which said solvent feed line extends through the interior of said vacuum line and terminates at the inteior of said cleaning tool.

21. The apparatus of claim 1 including control means comprising a pump pedal for activating said solvent pump when depressed and a vacuum pedal for activating said vacuum means when depressed, said pedals being closely adjacent whereby they can be depressed independently of one another or injunction with one another.

22. The apparatus of claim 21 in which said solvent feed line extends through the interior of said vacuum line and terminates at the interior of said cleaning tool.

23. The apparatus of claim 22 in which said solvent line terminates in a flexible discharge portion.

24. The apparatus of claim 1 in which said solvent pump is submersible and is positioned within said reservoir.

25. The apparatus of claim 24 in which said solvent pump has a fluid inlet assembly and said solvent pump is mounted to a bottom of said reservoir by said inlet assembly.

26. A method for cleaning printing ink from a printing screen comprising:

providing an organic solvent reservoir;

pumping organic solvent from said reservoir to said work surface to be cleaned at a point directly adjacent a cleaning tool having brush means thereon;

brushing the surface to be cleaned with said cleaning tool brush means to loosen ink on the surface to be cleaned; and drawing a vacuum on said solvent reservoir and connecting a vacuum opening on said cleaning tool to said solvent reservoir via a vacuum line whereby solvent applied to the surface to be cleaned is immediately picked up along with loosened ink by said cleaning tool and drawn by said vacuum back into said solvent reservoir.

27. The method of claim 26 which includes the use of a water soluble, biodegradable organic solvent which will dissolve said non-water soluble residue; disposing of said residue laden solvent by adding water thereto, thereby dissolving said water soluble solvent and forcing said non-water soluble residue to precipitate out; and separating said residue from said water and water soluble solvent.

28. The method of claim 27 which additionally includes introducing said residue laden solvent into a container lined with plastic, whereby when water is introduced, said non-water soluble residue tends to separate out and collect on said plastic liner; disposing of said residue coated plastic liner after said water and water soluble solvent have been decanted out of said container.

29. The method of claim 28 which additionally includes filtering said water and solvent through a filter to facilitate separation of said residue from said water and solvent.

30. The method of claim 27 which additionally includes filtering said water and solvent through a filter to facilitate separation of said residue from said water and solvent.

31. The method of claim 26 which includes providing means for drawing said vacuum and pumping said organic solvent either independently of one another or simultaneously to thereby facilitate directing more solvent on the work surface to be cleaned initially and drawing more vacuum towards the end of the operation to facilitate final clean up.

32. The method of claim 31 which includes filling said organic solvent reservoir by independently drawing a vacuum on said solvent reservoir while locating said cleaning tool within a source of solvent, and refraining from pumping organic solvent from said reservoir while said reservoir is filling.

33. The method of claim 31 which includes emptying said reservoir by pumping organic solvent from said reservoir without drawing a vacuum on said solvent reservoir while holding said cleaning tool adjacent a container into which solvent from said reservoir is to be pumped.

* * * * *